United States Patent [19]

Drockila

[11] Patent Number: 4,516,526

[45] Date of Patent: May 14, 1985

[54] MEANS FOR MARKING TIMBER PACKAGES

[75] Inventor: Kalevi Drockila, Kyminlinna, Finland

[73] Assignee: Rauma-Repola Oy, Finland

[21] Appl. No.: 608,442

[22] Filed: May 9, 1984

[51] Int. Cl.[3] ..... B05B 13/04; B05B 12/00

[52] U.S. Cl. ..... 118/697; 118/323; 427/421

[58] Field of Search ..... 118/323, 697; 427/421

[56] References Cited

U.S. PATENT DOCUMENTS

| | | | |
|---|---|---|---|
| 3,606,162 | 9/1971 | Lehmann | 118/323 X |
| 4,015,560 | 4/1977 | Paul | 118/323 X |
| 4,048,956 | 9/1977 | Estebanez | 118/323 X |
| 4,108,105 | 8/1978 | Wiggins | 118/323 |
| 4,125,035 | 11/1978 | Dooley | 118/323 X |
| 4,357,900 | 11/1982 | Buschor | 118/323 X |
| 4,364,330 | 12/1982 | Pearl | 118/697 |

*Primary Examiner*—Shrive P. Beck

[57] ABSTRACT

A marking means for timber packages (1), by which on the side (3) of the timber package are imprinted with a paint spray gun (2) the data relating to the timber package and to the goods contained therein. The paint gun (2) is movable under remote control in a coordinate-controlled plane beside the timber package (1), spraying the prescribed markings on the side of the timber package.

5 Claims, 1 Drawing Figure

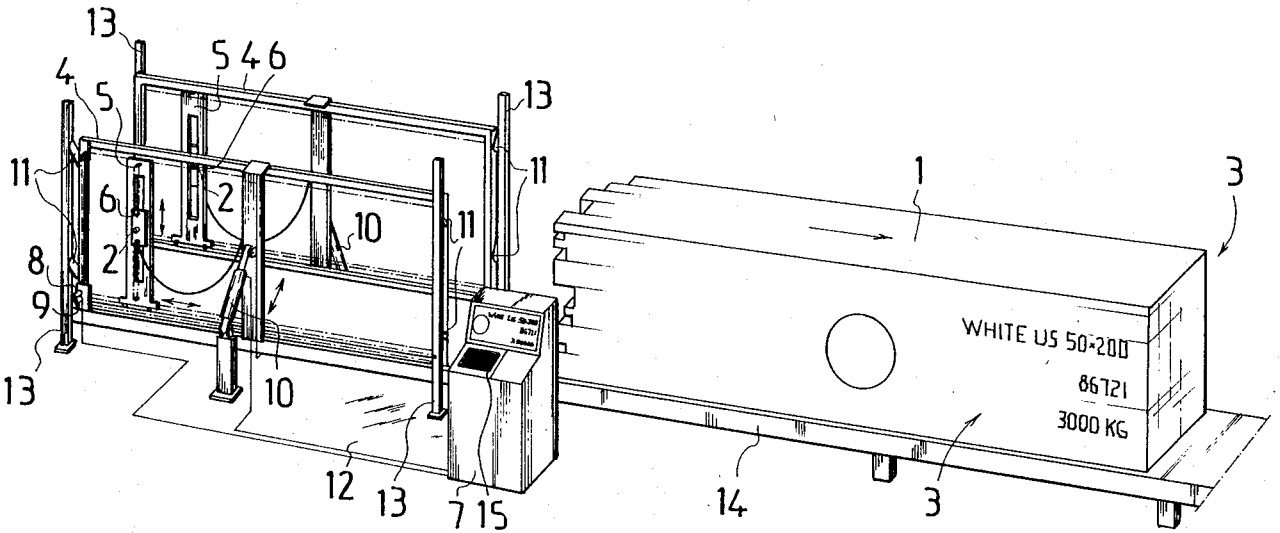
WHITE US 50-200
86721
3000 KG
1
2
3
4
5
6
7
8
9
10
11
12
13
14
15

MEANS FOR MARKING TIMBER PACKAGES

The present invention concerns a means for marking timber packages, by which on the side of the timber package is imprinted with a paint spray gun, the information relating to the timber package and to the goods contained therein.

Nowadays, such marking is done with the aid of stencils, implying that for the imprinting of each numeral or character or group composed of such the stencil has to be changed, and a brush or spray gun is used to apply paint through the stencil on the timber package. This is exceedingly time-consuming and inconvenient.

The object of the present invention is to provide a marking means which is easy to use and swift and which produces tidy impressions. The marking means of the invention is characterized in that the spray gun is movable under remote control in a coordinate-controlled plane beside the timber package, spraying predetermined markings on the side of the timber package.

It is possible with the aid of the invention, using a simply remote controlled paint gun, directly to write prescribed markings on the side of the package. When the paint gun is kept close enough to the timber package during the marking process, very tidy and sharply delimited markings are obtained.

One advantageous embodiment of the invention is characterized in that the plane is established by a frame located beside the timber package, carrying a horizontally movable carriage, on which has been mounted a vertically movable slide, to which the paint gun has been affixed. The coordinate system thus established is simple and favourable in manufacturing. The movements of the paint gun are controllable with ease within the frame.

Another embodiment of the invention is characterized in that the movements of the carriage and slide are electrically controlled from a control desk belonging to the means as a part thereof. It is thereby possible to carry out the marking of the timber package e.g. from a warm indoor space where the control desk has been placed.

A third embodiment of the invention is characterized in that the control desk comprises a pre-programmed memory which automatically causes the paint gun to make those markings which are constantly recurrent. Such preprogrammed markings may be, for instance: the company emblem, the timber sort and quality, and the dimensions. This makes for significantly speedier marking.

One embodiment of the invention is further characterized in that the frame is controllable e.g. with the aid of a pressure cylinder, in accordance with the size of the package, to be positioned immediately beside the package. The package size may vary, and in order that a uniform and tidy appearance of the markings might be preserved the distance of the paint gun from the timber package can thus be adjusted to be always the same.

The invention is described in the following with the aid of an example, with reference being made to the attached drawing, which presents a timber package marking means, viewed obliquely from above.

With the timber package marking means, the paint gun 2 is used to mark on the side 3 of the timber package the information relating to the timber package and to the goods contained therein, such as quality and dimensions, serial number of the package, and the company emblem. The paint gun 2 is movable under remote control in a coordinate-controlled plane beside the timber package 1, spraying the markings which are desired onto the side 3 of the timber package. The plane is established by a frame 4 disposed beside the timber package, carrying a horizontally movable carriage 5, on which has been mounted a vertically movable slide 6, to which the paint gun has been affixed. The movements of carriage and slide are electrically controlled from a control desk 7 forming part of the means. To the frame 4 have been affixed two electric motors 8,9, which take care by wire control of the movements of carriage 5 and slide 6. The frame 4 can be run by means of a pressure cylinder 10, suiting the size of the package 1, to be quite close to the side 3. The frame 4 has by a four-pivot linkage 11 been pivotally attached to a carrying structure 13 supported by the base 12 and thereby remains in a vertical plane at all times.

The timber package 1 is introduced along the track 14, from the left in the FIGURE, to the marking means and stopped in register with the frames 4, whereafter the frames are moved against the sides 3 of the timber package. The desired markings are typed on the keyboard 15 of the control desk. The control desk 7 contains a preprogrammed memory which automatically imprints the constantly recurring markings, such as company emblem, timber quality, etc. After all the requisite markings and data have been entered at the control desk 7, the means performs the marking on both long sides 3 of the timber package 1. On completed marking, the frames 4 withdraw from the sides of the package and the package is allowed to proceed on the track to the next handling step.

It is obvious to a person skilled in the art that different embodiments of the invention may vary within the scope of the claims presented below.

I claim:

1. A marking apparatus for imprinting the sides of timber packages with data relating to the packages and the goods contained therein, said packages being movable to a marking station at which said apparatus is located, said apparatus comprising a support structure, a vertically disposed frame pivotally attached to said support structure for establishing a coordinate-controlled plane beside one side of a package at said station, a horizontally movable carriage carried by said frame, a vertically movable slide mounted on said carriage, a paint spray gun fixed on said slide, power means for operating said carriage and slide as well as power means for moving said frame from a first position away from the side of the package to a second position close to the side of the package, and remote control means for actuating said power means and spray gun to spray prescribed markings on the side of said package.

2. A marking apparatus according to claim 1, wherein said remote control means comprises a control desk for electrically controlling said power means.

3. A marking apparatus according to claim 2, wherein said control desk contains a preprogrammed memory which automatically causes the paint gun to make constantly securing markings.

4. A marking apparatus according to claim 1, wherein said power means for moving said frame comprises a pressure cylinder for moving said frame in accordance with the size of the package so as to be closely adjacent thereto.

5. A marking apparatus according to claim 1, wherein there is provided a substantially identical frame, carriage, slide, spray gun and power means beside the other side of a package at said station operable by said remote control means whereby both sides of the package receive prescribed markings simultaneously.

* * * * *